US007556104B2

(12) United States Patent
Jeffryes

(10) Patent No.: US 7,556,104 B2
(45) Date of Patent: Jul. 7, 2009

(54) SYSTEM AND METHOD FOR PROCESSING AND TRANSMITTING INFORMATION FROM MEASUREMENTS MADE WHILE DRILLING

(75) Inventor: Benjamin Peter Jeffryes, Histon (GB)

(73) Assignee: Schlumberger Technology Corporation, Ridgefield, CT (US)

( * ) Notice: Subject to any disclaimer, the term of this patent is extended or adjusted under 35 U.S.C. 154(b) by 0 days.

(21) Appl. No.: 12/046,257

(22) Filed: Mar. 11, 2008

(65) Prior Publication Data

US 2008/0216568 A1 Sep. 11, 2008

Related U.S. Application Data

(62) Division of application No. 10/732,995, filed on Dec. 11, 2003, now Pat. No. 7,363,988.

(30) Foreign Application Priority Data

Dec. 11, 2002 (GB) ..... 0228893.4

(51) Int. Cl.
*E21B 47/12* (2006.01)

(52) U.S. Cl. ..... 175/40; 175/24; 175/48

(58) Field of Classification Search ..... 175/40, 175/24, 48

See application file for complete search history.

(56) References Cited

U.S. PATENT DOCUMENTS 4,216,536 A 8/1980 More
5,381,092 A * 1/1995 Freedman ..... 324/303
5,627,768 A 5/1997 Uhlmann et al.
5,663,929 A 9/1997 Pavone et al.
5,745,392 A 4/1998 Ergas et al.
5,812,068 A 9/1998 Wisler et al.
6,382,331 B1 5/2002 Pinckard
6,405,136 B1 6/2002 Li et al.

FOREIGN PATENT DOCUMENTS

EP 0384537 A1 8/1990
EP 0551134 A1 7/1993

* cited by examiner

*Primary Examiner*—Giovanna C Wright
(74) *Attorney, Agent, or Firm*—Steven Gahlings; James McAleenan

(57) ABSTRACT

Methods and systems are disclosed for downhole processing of measurements made in a wellbore during the construction of the wellbore. The system includes sensors located downhole adapted to measure downhole parameters. The system uses a downhole processor to calculate a statistical relationship, preferably covariance, between the two downhole parameters. A transmitter located downhole and in communication with the downhole processor is used to transmit the calculated statistical relationship to the surface. At the surface the statistical relationship is compared with surface acquired data and surface drilling operating parameters are altered based on the statistical relationship.

8 Claims, 6 Drawing Sheets

SYSTEM AND METHOD FOR PROCESSING AND TRANSMITTING INFORMATION FROM MEASUREMENTS MADE WHILE DRILLING

This application claims the benefit of and is a divisional of U.S. application Ser. No. 10/732,995 filed on Dec. 11, 2003, which is incorporated by reference in its entirety for all purposes.

FIELD OF THE INVENTION

The present invention relates to the field of downhole measurements. In particular, the invention relates to systems and methods for making measurements in a wellbore and processing and transmitting the same.

BACKGROUND OF THE INVENTION

There are generally two types of measurements made downhole—measurements of the rock surrounding the borehole (often referred to as formation evaluation) and measurements of the borehole and drilling assembly (often referred to as drilling monitoring). Examples of drilling monitoring include the following:

- Angular displacement (DC magnetometer or gravimeter) or rotation speed (rate of change of angle, or directly derived from radial accelerometers) of the drillstring assembly, either above or below the motor.
- Accelerations—measured using accelerometers, at each location along the drillstring there are 3 directions of linear acceleration, and one direction of rotational acceleration.
- Strains—generally measured using combinations of strain gauges—such as weight, torque and bending moment. Also strain on components such as cutter lugs.
- Pressures—absolute pressures measured inside and outside the drillstring and differential pressures, between the inside of the BHA and the annulus, or across the drilling motor or other downhole devices.
- Speeds and torques of rotating components—such as turbines, drilling motors, mud pulsers.
- Flow rates—generally these are inferred from other measurements such as turbine speed.
- Temperatures—both mud temperatures inside and outside the drillstring, and component temperatures (such as bit bearings).

Drilling monitoring data such as these as well as other types of drilling monitoring data generally have to be subjected to some form of data processing before transmission to the surface using while-drilling telemetry. Aside from just reducing the sampling rate to be compatible with the transmission rate, various means have been proposed for capturing some of the detail of the high frequency data in a few numbers that can be transmitted using available telemetry. Known processing techniques can consist of simple methods (such as mean, standard deviation, maximum and minimum) or more complicated procedures (spectra or wavelet analysis). The motivation for these procedures is the data bottleneck resulting from the slow telemetry rate from downhole to surface.

For example, U.S. Pat. No. 4,216,536 discloses calculating various properties (mean, positive and negative peaks, standard deviation, fundamental and harmonic frequencies and amplitudes), and transmitting a selection of these while drilling. U.S. Pat. No. 5,663,929 discloses the use of the wavelet transform to reduce the amount of data.

While both these types of methods serve the function of data reduction within in a single data channel, the usefulness of preserving high-frequency information that shows how different channels relate to one another was not appreciated. In general in the prior art it was not appreciated that one could capture information on the quantitative relationship between multiple channels at frequencies greatly in excess of the sampling rate.

SUMMARY OF THE INVENTION

Thus, it is an object of the present invention to provide a system and method that allows for a multi-channel data envelope to be generated at surface with relatively little data transmitted from downhole.

According to the invention a system is provided for making measurements in a wellbore during the construction of the wellbore. The system includes a first sensor located downhole adapted to measure a first downhole parameter, and a second sensor located downhole adapted to measure a second downhole parameter. The system uses a downhole processor in communication with the first and second sensors to calculate a statistical relationship between the first and second downhole parameters. A transmitter located downhole and in communication with the downhole processor is used to transmit the calculated statistical relationship to the surface.

The statistical relationship is preferably a covariance, and preferably standard deviation and/or mean are calculated as well. The downhole parameters are preferably torque and weight on bit; pressure and weight on bit; toolface and weight on bit; or annular pressure and downhole flow rate.

The system preferably also includes a receiver located on the surface positioned and configured to receive the calculated statistical relationship transmitted by the transmitter, and a surface processor in communication with the receiver programmed to analyse the calculated statistical relationship. Based on the analysis, operating drilling parameters are preferably altered.

The invention is also embodied in a method for making measurements in a wellbore.

DETAILED DESCRIPTION OF THE INVENTION

Figure 1:
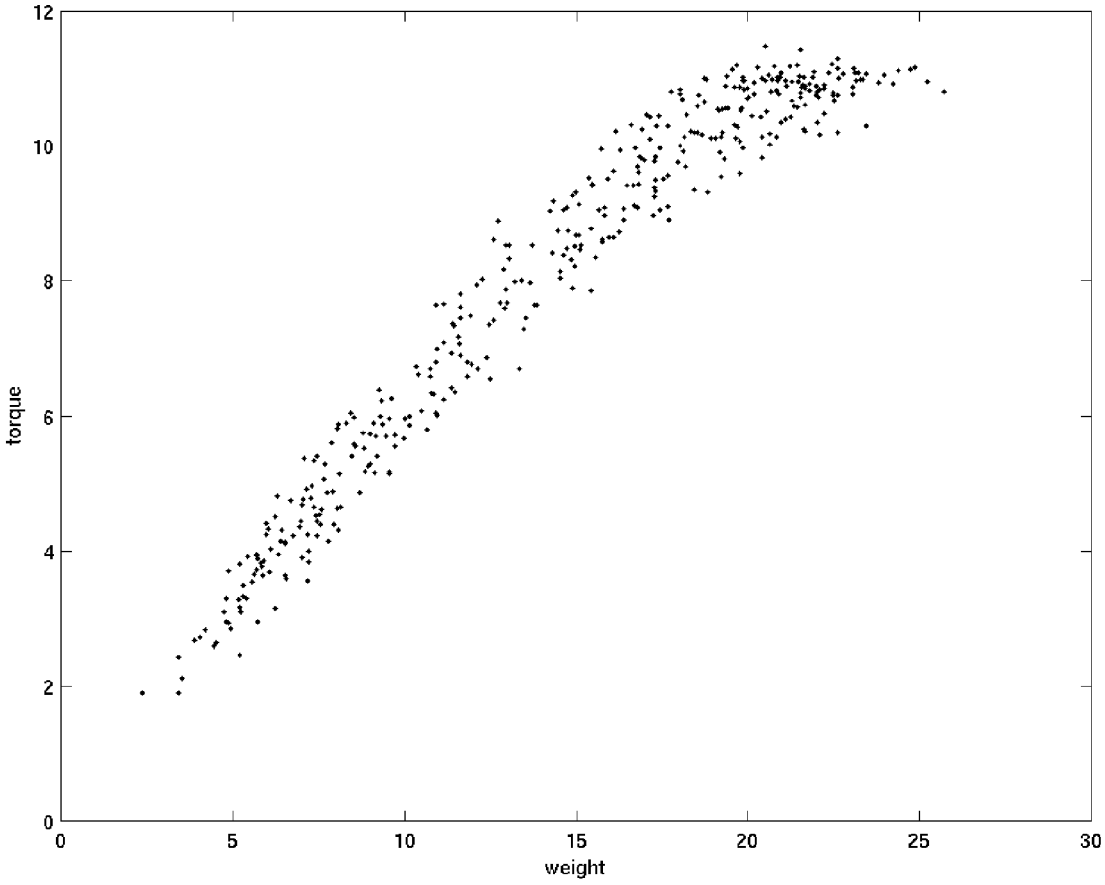
FIG. 1 shows simulated data of weight and torque for a bit, where noise has been added independently to both data.

According to a preferred embodiment of the invention, a method is provided to calculate and transmit either the covariance of the channels, or regression coefficient (covariance divided by the product of the standard deviations), in combination with individual channel means and variances (or alternatively, standard deviations).

More generally, according to another embodiment of the invention, the data in each channel can be transformed by a linear transformation—and the covariance calculated after the transformation. An example of this is the Fourier transform.

According to a preferred embodiment a system and method for downhole data processing of drilling monitoring measurements using a time domain covariance calculation will now be explained. Consider two channels, x and y, sampled at n samples/second. The covariance $C_{xy}$, calculated over N seconds is given by $$C_{xy} = \sum_{j=1}^{j=Nn} (x_j - \langle x \rangle)(y_j - \langle y \rangle)$$

where $\langle x \rangle$ denotes the mean value of x over the N seconds, and $\langle y \rangle$ denotes the mean value of y over the N seconds. An equivalent expression for the covariance is $$C_{xy} = \sum_{j=1}^{j=Nn} (x_j y_j - \langle x \rangle \langle y \rangle)$$

The regression coefficient for the two channels is given by the covariance, divided by the individual channel standard deviations. This has the advantage of always lying between −1 and 1.

The benefit of the covariance calculation is that it allows the best linear relationship (in a least-squares sense) between two measurements to be derived, as well as providing a measure of the fit (the regression coefficient). Therefore allows one to better estimate and determine downhole conditions. For example, if the two channels are torque and weight on bit, the invention will allow for an improved interpretation of bit wear. In another example where the channels are toolface and weight on bit, the invention allows for improved control of the drilling direction while sliding by varying the weight on bit.

Minimizing the errors in y in this case gives as the best-fit line.

$$(y - \langle y \rangle) = \frac{C_{xy}}{\sigma_x^2}(x - \langle x \rangle)$$

Similar expression exist for best-fit linear relationships between more than two channels, which require to be transmitted the individual channel means and standard deviations (or variances), and all the covariances between the different channels.

According to another embodiment of the invention a method and system using a time-delayed covariance calculation will now be described. Another set of downhole covariances that may be calculated relate data in one channel to time-delayed data from another channel. For the two channels x and y we obtain covariances such as $$C_{xy}^k = \sum_{j=1}^{j=Nn} (x_j - \langle x \rangle)(y_{j-k} - \langle y \rangle)$$

If these covariances are calculated for k=−1, 0, 1 then linear relationships between x and the rate of change of y (or vice versa) may be deduced.

According to another embodiment of the invention a method and system using frequency domain covariance calculation (or channel filtering) will be described.

Time domain covariance calculations show simple relationships between channels (for instance, x is proportional to y, plus an offset) Sometimes more general frequency domain covariances are useful if it is unclear what kind of linear model relates two or more channels, or to provide evidence that no good linear model exists. For example, if large fluctuations in torque are being measured accompanied by large variations in downhole pressure, one would like to determine if there is a strong relationship between the two channels which would indicate the a common cause being possibly related to conditions near the drill bit rather than due to multiple causes at different locations within the borehole. According to this embodiment, some frequency domain calculation is made which is part of a general class of more complicated single channel data transformations. After this calculation, the covariance of the data in different channels is calculated.

1. Choose a time window (N samples)
2. Every N/2 samples, take the previous N samples.
3. Multiply by a window function (cosine bell, parabola)
4. Pad with N zeros
5. Take Fourier transform of length 2N.

This generates N complex numbers every N/2 samples, per channel, and so is oversampling the data. What is of interest in the data is not the phase of each channel, but the amplitudes and the relative phase between channels.

Similarly to before, we can take the Fourier transformed data from M windows (i.e. covering time domain data from the previous (M+1)N/2 samples) and for each frequency f and pairs of channels x and y we may calculate $$\langle x_{kf}^2 \rangle = \frac{1}{M}\sum_{k=1}^{m} x_{kf}\bar{x}_{kf}$$

$$\langle y_{kf}^2 \rangle = \frac{1}{M}\sum_{k=1}^{m} y_{kf}\bar{y}_{kf}$$

$$\langle x_{kf}\bar{y}_{kf} \rangle = \frac{1}{M}\sum_{k=1}^{m} x_{kf}\bar{y}_{kf}$$

Here the small bars denote complex conjugation. From these averages, the best-fit transfer function from x to y (and vice versa) may be deduced.

As well as 'box car' averages such as those shown above, other averaging methods may be used such as combining summation with a weighting function, or recursive exponential filtering.

As well as providing means for quantitative assessment of relationships between variables, providing covariance information, in addition to means and variances allows the qualitative, visual relationship to be appreciated, as the following example demonstrates wherein a system and method using covariance calculations is applied to weight and torque.

FIG. 1 shows simulated data of weight and torque over 200 seconds for a bit, where noise has been added independently to both data. The weight-torque relationship is linear at low weights and then flattens out.

Figure 2:
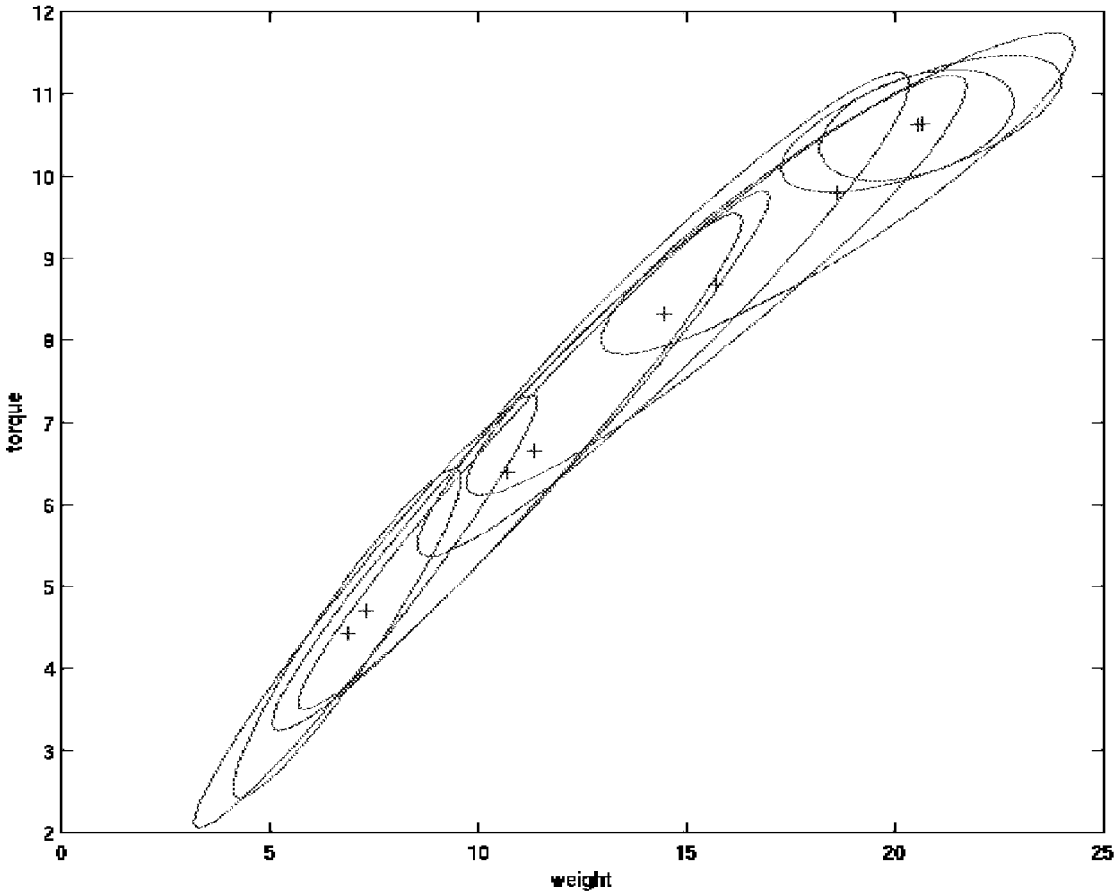
FIG. 2 shows the means, variances and covariances calculated from the data shown in FIG. 1.

FIG. 2 shows the means, variances and covariances calculated from the data shown in FIG. 1. For FIG. 2, the period of calculation is 20 seconds. The positions of the crosses are given by the mean values of weight and torque over the period. The vertical and horizontal extent of each ellipse is 1.5 times the standard deviation of the torque and weight respectively, and the ratio of the major to the minor axes of the ellipse is derived from the regression coefficient (the covariance divided by the product of the standard deviations).

If the regression coefficient is zero, the ratio is the ratio of the standard deviations. As the absolute value of the regression coefficient increases, the ellipse becomes closer to a straight line.

Figure 3:
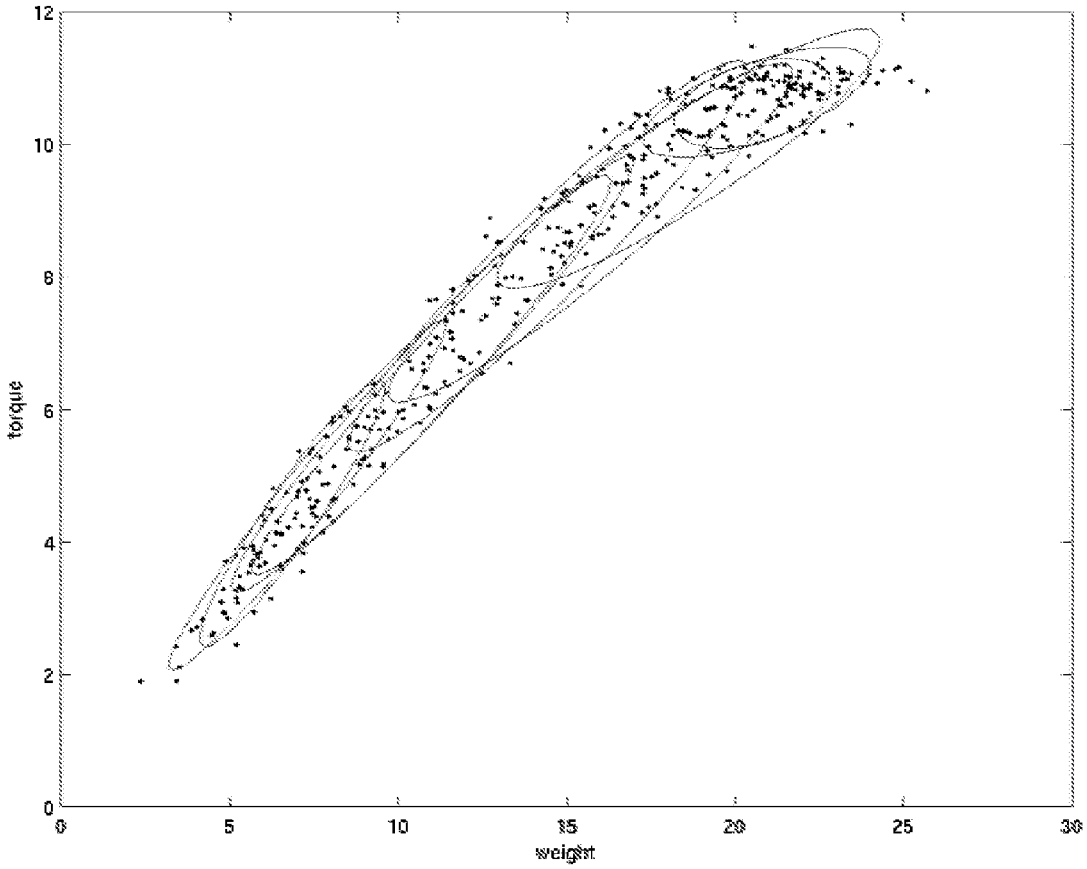
FIG. 3 shows a superposition of the ellipses onto the data points from FIG. 1.

FIG. 3 shows a superposition of the ellipses onto the data points from FIG. 1. It can be seen that ellipse reflect accurately the position of the original data.

According to another embodiment of the invention, on the surface the data can be compared with data acquired from offset wells, in order to compare the performance of different bits or for other purposes.

According to another embodiment of the invention, based on the profile of bit behavior obtained in a picture such as is shown in FIG. 2, the operating parameters of drilling are changed. For example, if optimum bit performance is obtained in the regime where the bit-torque relationship is linear, then FIG. 2 shows clearly that weight-on-bit should be restricted to values below 20. Examining the mean values (the crosses) in FIG. 2, it is clear that this conclusion cannot be drawn from the mean values alone.

According to another embodiment of the invention, at the surface, similar mechanical measurements can also be made—in particular weight-on-bit and torque, as well as other measurements such as rate-of-penetration that cannot be made downhole. The surface measurements are available at high speed, however they contain contributions both from the bit and the drillstring. For instance, both the weight-on-bit and torque measured at surface will be greater than those measured downhole due to frictional effects in the wellbore.

By applying similar processing to surface measurements as was made to the downhole measurements, the two sets of measurements may be compared, and the frictional correction estimated so that downhole weight and torque may be estimated from the surface. As well as downhole calculation of covariances of measurements such as weight and torque against each other, calculating and transmitting uphole the covariance of these measurements against time enables is especially useful in matching surface and downhole measurement of similar quantities.

Comparison of the variances of the surface and downhole measurements also enables error estimates to be made on the accuracy of frictional correction.

As well as processing surface measurements that are equivalent to downhole measurements, the calculation of means, variances and covariances of surface measurements (such as weight) with those that are only available at the surface (such as rate-of-penetration) enables further aspects of bit behaviour to be elucidated. For example, once the relationship between the surface and downhole weight has been established, the relationship between weight-on-bit and rate-of-penetration can be deduced.

According to another embodiment of the invention, a system and method for relating weight on bit to toolface will be described. During sliding drilling the orientation of the drillstring has to be controlled so that drilling proceeds in the desired direction. While the orientation of the top of the drillstring is directly controlled by the surface rotation apparatus (top drive or rotary table), reactive torque due to drilling means that the actual toolface angle for a long drillstring will be quite different. Since reactive torque is related to the weight applied to the bit, if WOB is changed then the surface toolface may also have to be changed to compensate. When a survey is taken at a connection and the surface toolface is adjusted without any weight applied to the bit, the driller must compensate for the expected reactive torque—and if on commencing drilling the downhole toolface differs considerably from the desired toolface then further adjustments have to be made, delaying the drilling process.

According to the invention data is transmitted to surface that shows how toolface would change with a change in weight, thereby making it easier to compensate toolface for WOB changes.

According to this embodiment the two downhole channels whose covariance we require are toolface and WOB. Toolface correction will be proportional to bit torque—however bit torque is not a quantity that the driller can directly control from surface. However, bit torque is directly related to WOB, often in a roughly linear manner but the constant of proportionality will vary with the rock being drilled, as well as other factors such as flow rate. Transmitting to surface while drilling the means and variance of the WOB and toolface channels, together with their covariance, allows the relationship to be monitored and also enables precise small toolface corrections to be made by adjusting WOB. It also allows a better correction to be made for the anticipated reactive torque when toolface adjustments are made with zero weight on bit.

According to another embodiment of the invention, a system and method for relating flow-rate and annular pressure is provided. During drilling there is normally an excess pressure in the annulus when pumping compared to when no fluid flow takes place, due to the frictional pressure created by fluid flow in the annular space. The pressure is a function of the fluid flow rate, and although it may vary non-linearly for the small fluid flow variations normally seen while drilling it will be nearly linear. The correlation between flow rate and annular pressure can be used to predict the effects of changing the flow rate substantially—either using the linear correlation directly or by using the linear correlation to calibrate a non-linear model. Normally the pump controller can maintain a very steady flow rate. As an extension to this embodiment, the surface flow rate can be deliberately varied, slowly, over a range in order to provide a good downhole measurement of the correlation. This correlation can also be measured when the pumps are switched off at the start of a connection, and the downhole flow rate drops to zero over a number of seconds.

Figure 4:
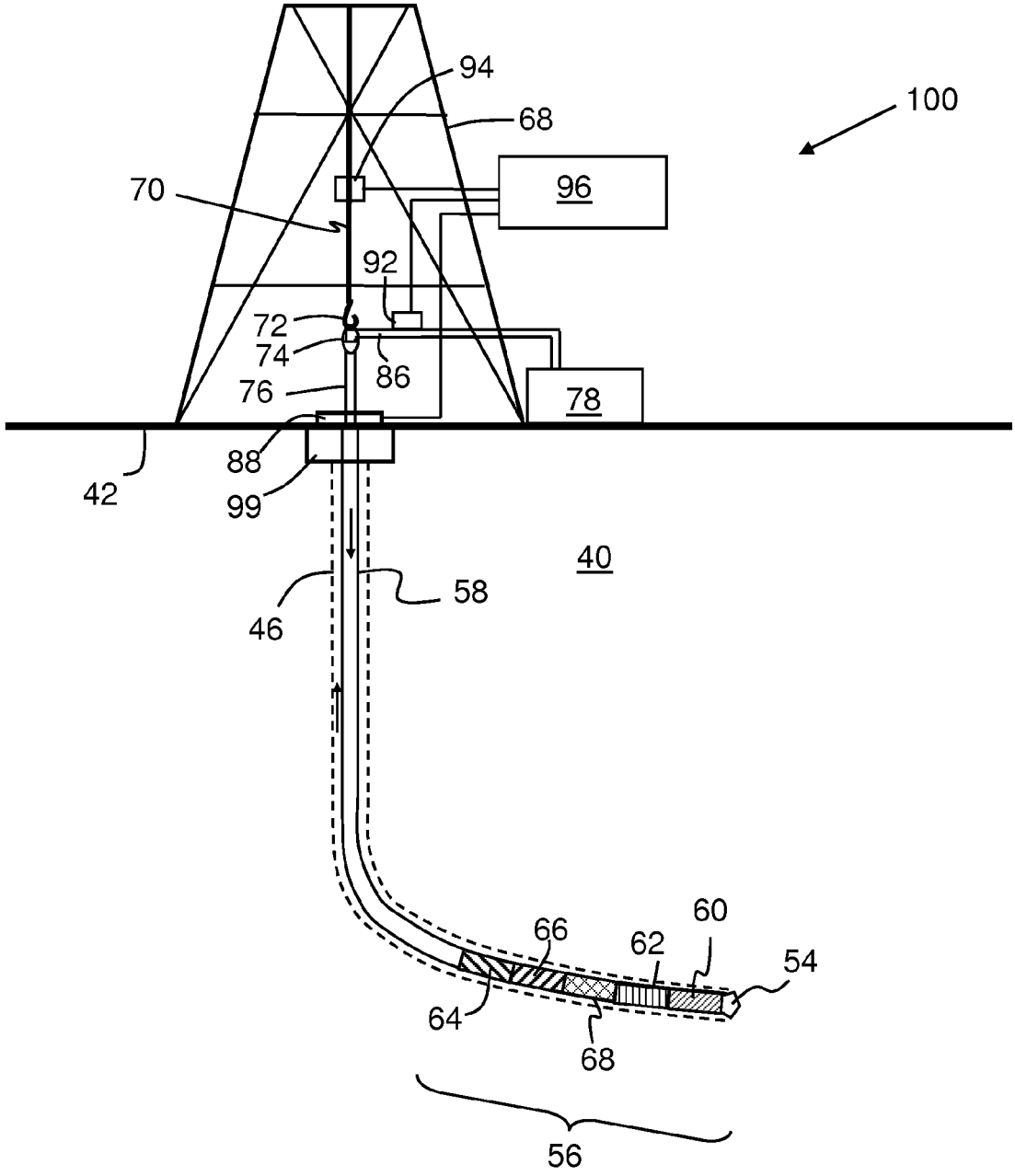
FIG. 4 shows a system for processing and transmitting downhole measurements according to preferred embodiments of the invention.

FIG. 4 shows a system for processing and transmitting downhole measurements according to preferred embodiments of the invention. Drill string 58 is shown within borehole 46. Borehole 46 is located in the earth 40 having a surface 42. Borehole 46 is being cut by the action of drill bit 54. Drill bit 54 is disposed at the far end of the bottom hole assembly 56 that is attached to and forms the lower portion of drill string 58. Bottom hole assembly 56 contains a number of devices including various subassemblies. According to the invention measurement-while-drilling (MWD) subassemblies are included in subassemblies 62. Examples of typical MWD measurements include direction, inclination, survey data, downhole pressure (inside the drill pipe, and outside or annular pressure), resistivity, density, and porosity. Also included is a subassembly 60 for measuring torque and weight on bit. In the case where rotary steerable drilling is being performed, additional measurements such as toolface (orientation) is provided in subassembly 66. Although these examples are given, it will be appreciated that measurements from many different types of sensors can be processed downhole and transmitted according to the present invention. The signals from the subassemblies 60, 62 and 68 preferably processed in processor 66. Processor 66 carries out the statistical downhole processing such as covariance, as has been described in the various embodiments above. After processing, the information from processor 66 is then communicated to pulser assembly 64. Pulser assembly 64 converts the information from processor 66, along with in some cases signals directly from one or more of the subassemblies 68, 62 and/or 60 into pressure pulses in the drilling fluid. The pressure pulses are generated in a particular pattern which represents the data from subassemblies 68, 62 and/or 60. The pressure pulses travel upwards though the drilling fluid in the central opening in the drill string and towards the surface system. The subassemblies in the bottom hole assembly 56 can also include a turbine or motor for providing power for rotating drill bit 54.

The drilling surface system 100 includes a derrick 68 and hoisting system, a rotating system, and a mud circulation system. The hoisting system which suspends the drill string 58, includes draw works 70, hook 72 and swivel 74. The rotating system includes kelly 76, rotary table 88, and engines (not shown). The rotating system imparts a rotational force on the drill string 58 as is well known in the art. Although a system with a kelly and rotary table is shown in FIG. 4, those of skill in the art will recognize that the present invention is also applicable to top drive drilling arrangements. Although the drilling system is shown in FIG. 4 as being on land, those of skill in the art will recognize that the present invention is equally applicable to marine environments.

The mud circulation system pumps drilling fluid down the central opening in the drill string. The drilling fluid is often called mud, and it is typically a mixture of water or diesel fuel, special clays, and other chemicals. The drilling mud is stored in mud pit 78. The drilling mud is drawn in to mud pumps (not shown) which pump the mud though stand pipe 86 and into the kelly 76 through swivel 74 which contains a rotating seal. In invention is also applicable to underbalanced drilling. If drilling underbalanced, at some point prior to entering the drill string, gas is introduced into drilling mud using an injection system (not shown).

The mud passes through drill string 58 and through drill bit 54. As the teeth of the drill bit grind and gouges the earth formation into cuttings the mud is ejected out of openings or nozzles in the bit with great speed and pressure. These jets of mud lift the cuttings off the bottom of the hole and away from the bit, and up towards the surface in the annular space between drill string 58 and the wall of borehole 46.

At the surface the mud and cuttings leave the well through a side outlet in blowout preventer 99 and through mud return line (not shown). Blowout preventer 99 comprises a pressure control device and a rotary seal. The mud return line feeds the mud into separator (not shown) which separates the mud from the cuttings. From the separator, the mud is returned to mud pit 78 for storage and re-use.

Various sensors are placed on the surface system 100 to measure various parameters. For example, hookload is measured by hookload sensor 94 and surface torque is measured by a sensor on the rotary table 88. Signals from these measurements are communicated to a central surface processor 96. In addition, mud pulses traveling up the drillstring are detected by pressure sensor 92, located on stand pipe 86. Pressure sensor 92 comprises a transducer that converts the mud pressure into electronic signals. The pressure sensor 92 is connected to surface processor 96 that converts the signal from the pressure signal into digital form, stores and demodulates the digital signal into useable MWD data. According to various embodiments described above, surface processor 96 is used to analyze the transmitted statistical relationship, such as covariance, and make comparisons with surface measured data such as hook load and surface torque.

Figure 5:
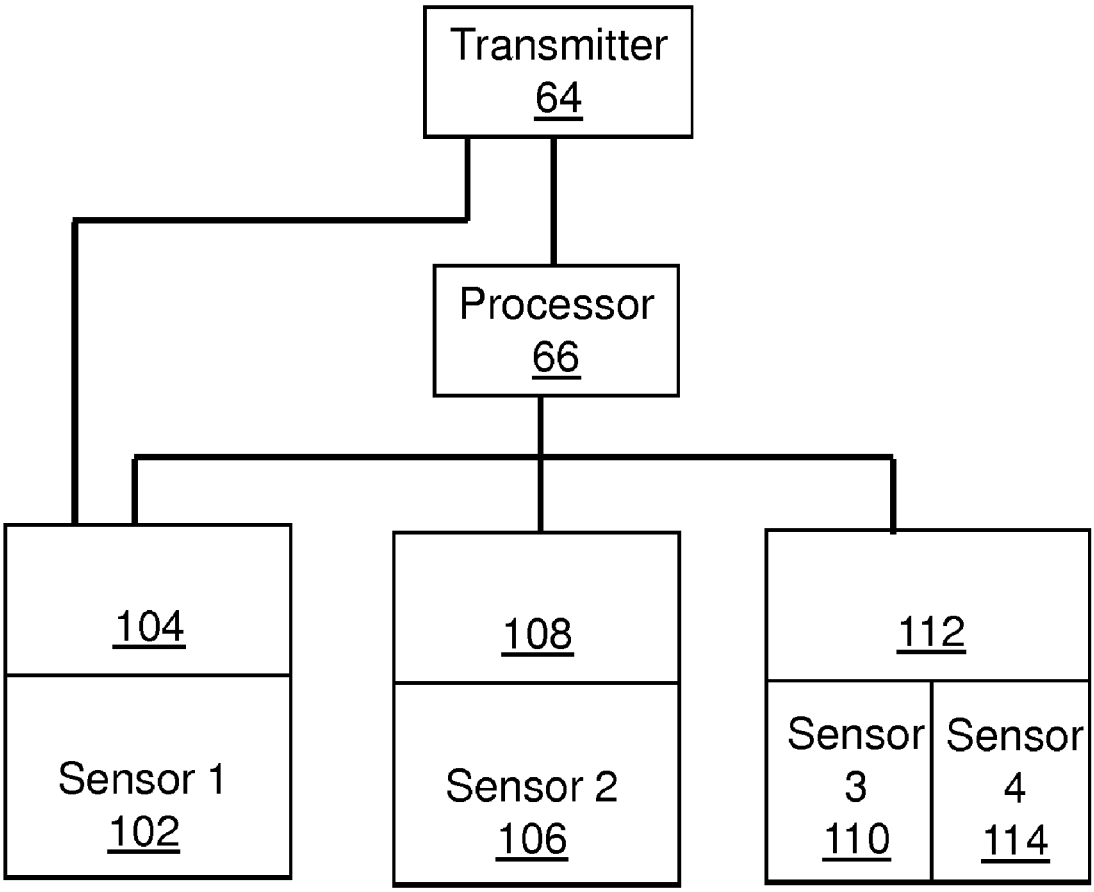
FIG. 5 schematically shows the organization and communication in the bottom hole assembly, according preferred embodiments of the invention.

FIG. 5 schematically shows the organization and communication in the bottom hole assembly, according preferred embodiments of the invention. In this example there are four downhole sensors 102, 106, 110 and 114 but in general there can be any number of sensors used to make measurements downhole. Associated with each of the sensors are local processors 103, 108 and 112. In this example, sensors 110 and 114 share a common local processor 112. The local processors are used to both control the sensor and to convert the measured signals into digital form. The local processors communicate the digital signals representing the downhole measurements to processor 66 which is used to carry out the statistical processing described herein. Processor 66 then communicates the downhole processed data to the pulser assembly 64 for transmission to the surface.

Figure 6:
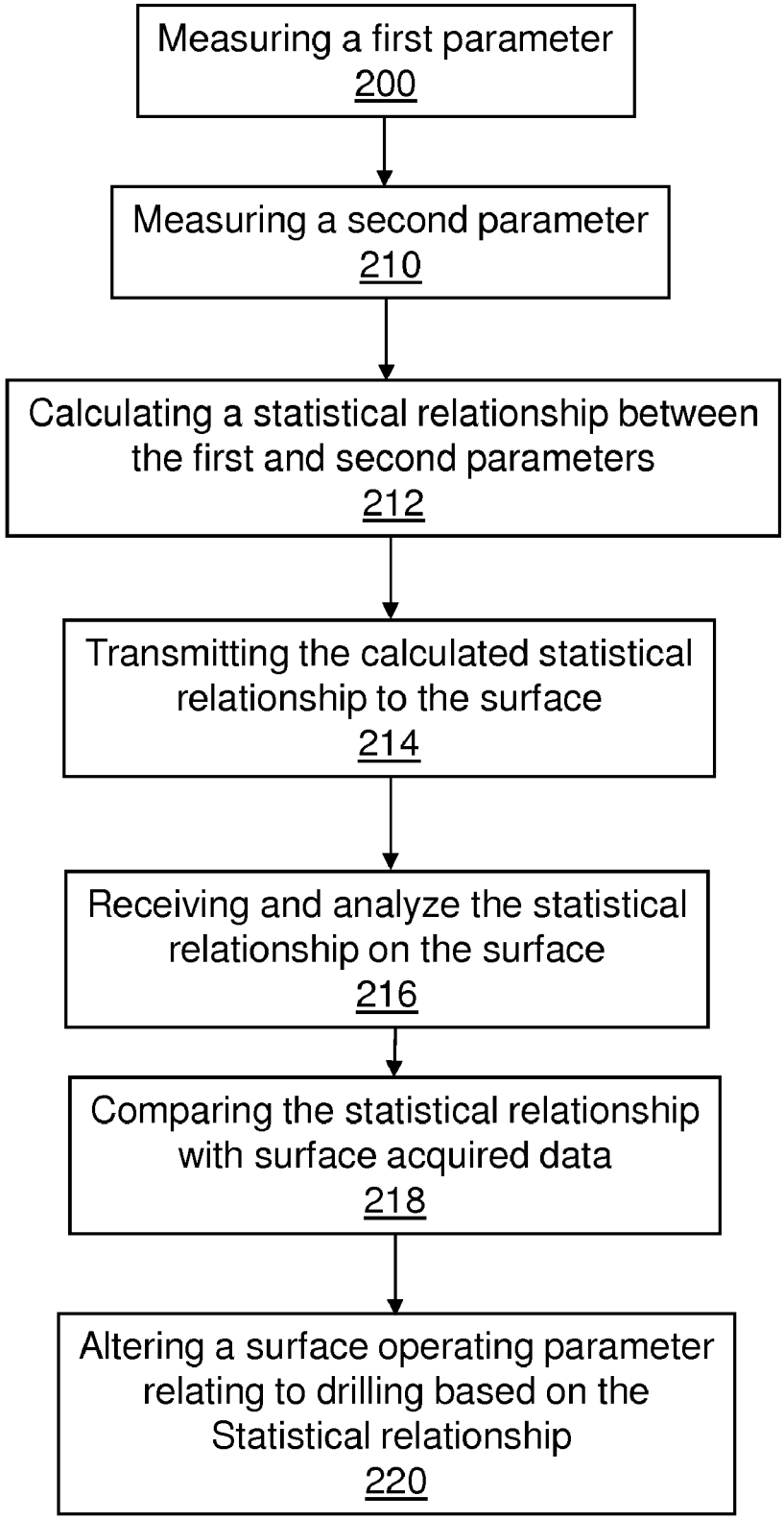
FIG. 6 is a flowchart showing various steps for measuring, processing and transmitting downhole measured data, according preferred embodiments of the invention.

FIG. 6 is a flowchart showing various steps for measuring, processing and transmitting downhole measured data, according preferred embodiments of the invention. In step s 200 and 210 first and second parameters are measured, as described herein, these measurements can be in general any downhole measurement. According to preferred embodiments, the parameters can be torque, weight on bit, internal pressure, annular pressure, toolface, or mud flowrate. In step 212 the statistical relationship between the two measured parameters, preferably a covariance, is calculated by a downhole processor. In step 214 the calculated statistical relationship is transmitted to the surface, preferably using some form of mud pulse telemetry. In step 216 statistical relationship is received on the surface and analysed. In step 218 the statistical relationship is compared with data acquired at the surface, such as hookload, and/or surface measured torque. Finally, in step 220, based on the analysis of the statistical relationship one or more surface operating parameters are altered due to the improved understanding about downhole conditions, as has been described above. For example, from the covariance of downhole torque and weight on bit, it can be determined that bit wear has reached a certain point and the drilling parameters altered accordingly. In the case the bit wear has reached a predetermined threshold value, the bit is replaced.

While the invention has been described in conjunction with the exemplary embodiments described above, many equivalent modifications and variations will be apparent to those skilled in the art when given this disclosure. Accordingly, the exemplary embodiments of the invention set forth above are considered to be illustrative and not limiting. Various changes to the described embodiments may be made without departing from the spirit and scope of the invention.

What is claimed is:

1. A method for making measurements in a wellbore, comprising the steps of:

measuring downhole a first parameter;

calculating a first mean and a first variance for the first parameter;

measuring downhole a second parameter;

calculating a second mean and a second variance for the second parameter;

calculating a covariance between the first and the second downhole parameters;

transmitting the first mean, the first variance, the second mean, the second variance and the covariance to the surface; and generating a multi-channel data envelope from the first mean, the first variance, the second mean, the second variance and the covariance.

2. A method according to claim 1, wherein the first and second parameters are selected from the group consisting of torque, weight on bit, annular pressure, pressure inside a drillstring, toolface, and flow rate of drilling mud.

3. A method according to claim 1, wherein the calculated covariance is a time-delayed covanance.

4. A method according to claim 1, further comprising the step of:

analyzing the multi-channel data envelope.

5. A method according to claim 4, wherein the step of analyzing the multi-channel data envelope comprises comparing the multi-channel data envelope with data acquired from one or more wellbores within a nearby region.

6. A method according to claim 4, wherein the step of analyzing the multi-channel data envelope comprises comparing the multi-channel data envelope with measurements acquired from surface equipment of the wellbore.

7. A method according to claim 4, further comprising the step of altering an operating parameter on the surface relating to drilling the wellbore based at least in part on the analyzed multi-channel data envelope.

8. A method according to claim 1 wherein the covariance is calculated from a linear transformation of the first and the second parameter.

* * * * *